US009070271B2

(12) United States Patent
Baade et al.

(10) Patent No.: US 9,070,271 B2
(45) Date of Patent: Jun. 30, 2015

(54) APPARATUS AND METHOD FOR DETECTING UNAUTHORIZED REMOVAL OF ASSET TRACKING DEVICE

(71) Applicant: Spireon, Inc., Knoxville, TN (US)

(72) Inventors: Levi M. Baade, San Clemente, CA (US); Ezra T. Peachey, San Diego, CA (US)

(73) Assignee: Spireon, Inc., Knoxville, TN (US)

( * ) Notice: Subject to any disclaimer, the term of this patent is extended or adjusted under 35 U.S.C. 154(b) by 109 days.

(21) Appl. No.: 13/683,068

(22) Filed: Nov. 21, 2012

(65) Prior Publication Data

US 2013/0127617 A1 May 23, 2013

Related U.S. Application Data

(60) Provisional application No. 61/562,526, filed on Nov. 22, 2011.

(51) Int. Cl.
*G08B 21/18* (2006.01)
*G08B 13/06* (2006.01)

(52) U.S. Cl.
CPC ..... *G08B 21/18* (2013.01); *G08B 13/06* (2013.01)

(58) Field of Classification Search
CPC ..... G08B 13/00; G08B 13/02; G08B 13/06; G08B 13/2462; G08B 13/2491
USPC ..... 340/539.31, 539.13, 541, 568.1, 568.2, 340/573.1, 825.49, 539.26, 540; 342/27, 28
See application file for complete search history.

(56) References Cited

U.S. PATENT DOCUMENTS

| | | | | |
|---|---|---|---|---|
| 5,731,757 | A | 3/1998 | Layson, Jr. | |
| 6,346,886 | B1 | 2/2002 | De La Huerga | |
| 6,448,889 | B1 | 9/2002 | Hudson | |
| 6,688,518 | B1 | 2/2004 | Valencia et al. | |
| 7,019,683 | B2 * | 3/2006 | Stevens et al. | 342/28 |
| 7,034,683 | B2 | 4/2006 | Ghazarian | |
| 8,111,157 | B2 * | 2/2012 | Diener et al. | 340/545.6 |
| 2004/0183673 | A1 | 9/2004 | Nageli | |
| 2006/0187033 | A1 * | 8/2006 | Hall et al. | 340/539.22 |
| 2009/0102653 | A1 | 4/2009 | McGinnis et al. | |
| 2009/0134999 | A1 | 5/2009 | Dobson et al. | |
| 2009/0289786 | A1 * | 11/2009 | Koch | 340/539.26 |
| 2010/0090825 | A1 | 4/2010 | Freathy | |
| 2011/0273852 | A1 | 11/2011 | Debrody et al. | |

FOREIGN PATENT DOCUMENTS

| | | |
|---|---|---|
| WO | 0214110 | 2/2002 |
| WO | 03042959 | 5/2003 |

* cited by examiner

*Primary Examiner* — Hung T Nguyen
(74) *Attorney, Agent, or Firm* — Luedeka Neely Group, P.C.

(57) ABSTRACT

An asset tracking device includes a mounting bracket and a housing attached to the mounting bracket. The mounting bracket includes a magnetic portion, first apertures that receive first fasteners for attaching the mounting bracket to the asset, and second apertures that receive second fasteners. Third apertures in the housing, aligned with the second apertures in the mounting bracket, receive the second fasteners for attaching the housing to the mounting bracket. When the housing is attached to the mounting bracket, the housing makes the fasteners in the mounting bracket inaccessible so that the mounting bracket cannot be removed from the asset. When the housing is removed from the mounting bracket, a magnetic switch changes state and triggers a controller to generate a tamper alert with location information indicating the location of the tracking device. A wireless transmitter wirelessly transmits the tamper alert and location information to a central monitoring station.

12 Claims, 4 Drawing Sheets

APPARATUS AND METHOD FOR DETECTING UNAUTHORIZED REMOVAL OF ASSET TRACKING DEVICE

RELATED APPLICATIONS

This invention claims all rights on and priority to U.S. provisional patent application 61/562,526 filed Nov. 22, 2011, titled APPARATUS AND METHOD FOR DETECTING UNAUTHORIZED REMOVAL OF ASSET TRACKING DEVICE.

FIELD

This invention relates to the field of determining and reporting locations of assets in transit. More particularly, this invention relates to a system for detecting unauthorized tampering with or removal of an asset tracking device from an asset, such as a shipping container or a cargo trailer.

BACKGROUND

Cargo containers, such as shipboard cargo containers and cargo trailers used in the trucking industry, are often tracked using small tracking devices attached to the containers. These tracking devices typically incorporate a GPS module for determining the location of the container and a wireless communication module, such as a cellular or satellite modem, to transmit the location information to a central monitoring station. The tracking devices are usually attached to the containers using screws or "peel and stick" adhesive pads.

Such tracking devices are vulnerable to unauthorized removal, such as by thieves who have stolen the cargo container to which the tracking device is attached. Typically, if a thief is aware of the presence of the tracking device, the thief will remove the device at the first opportunity and discard it to prevent tracking of the stolen container. With conventional tracking devices, removal is fairly straightforward, and may involve only removing a few screws or peeling away an adhesive pad.

Typically, unless the tracking device is damaged during the removal process, the device continues to transmit its location to the central monitoring station with no indication that the device has been removed from the container. In such a situation, without other independent information regarding the theft or a geofence trigger event from the tracking device, the central monitoring entity may have no indication that the container has been stolen.

What is needed, therefore, is a system for sensing removal of a tracking device from a container or other asset, and for transmitting a notification signal to a central monitoring station upon such removal.

SUMMARY

The above and other needs are met by an asset tracking device that includes a mounting bracket configured for secure attachment to a surface of an asset to be tracked and a housing configured to be securely attached to the mounting bracket. Within the housing are a magnetic switch, a controller, a location determination circuit, and a wireless transmitter. In a preferred embodiment, the mounting bracket includes a magnetic portion, first apertures configured to receive first fasteners for securely attaching the mounting bracket to the surface of the asset, and second apertures configured to receive second fasteners. The housing has third apertures substantially aligned with the second apertures in the mounting bracket. The third apertures are configured to receive the second fasteners for securely attaching the housing to the mounting bracket. The housing is sized and configured to make the first fasteners in the mounting bracket inaccessible when the housing is attached to the mounting bracket. With this configuration, the mounting bracket may not be removed from the surface of the asset when the housing is attached to the mounting bracket. The magnetic switch, which is disposed in or on the housing, is configured to attain a first state when the housing is attached to the mounting bracket and a second state when the housing is not attached to the mounting bracket. The controller is operable to generate tamper alert information based on the magnetic switch changing from the first state to the second state. The location determination circuit generates location information indicative of a location of the asset tracking device. The wireless transmitter is configured to wirelessly transmit the tamper alert information and the location information.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
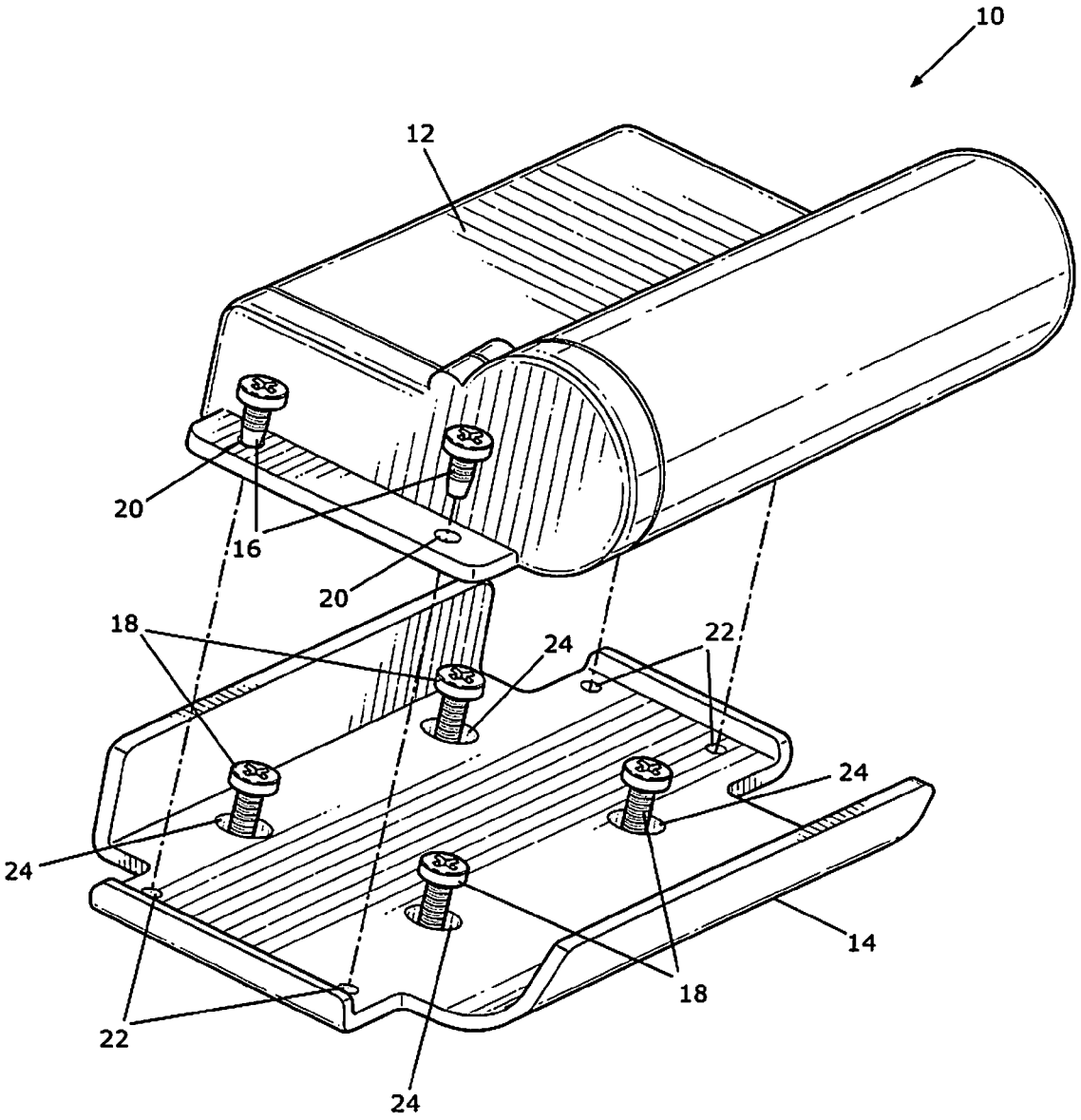
FIGS. 1-3 depict an asset tracking device according to an embodiment of the present disclosure.
Figure 2:
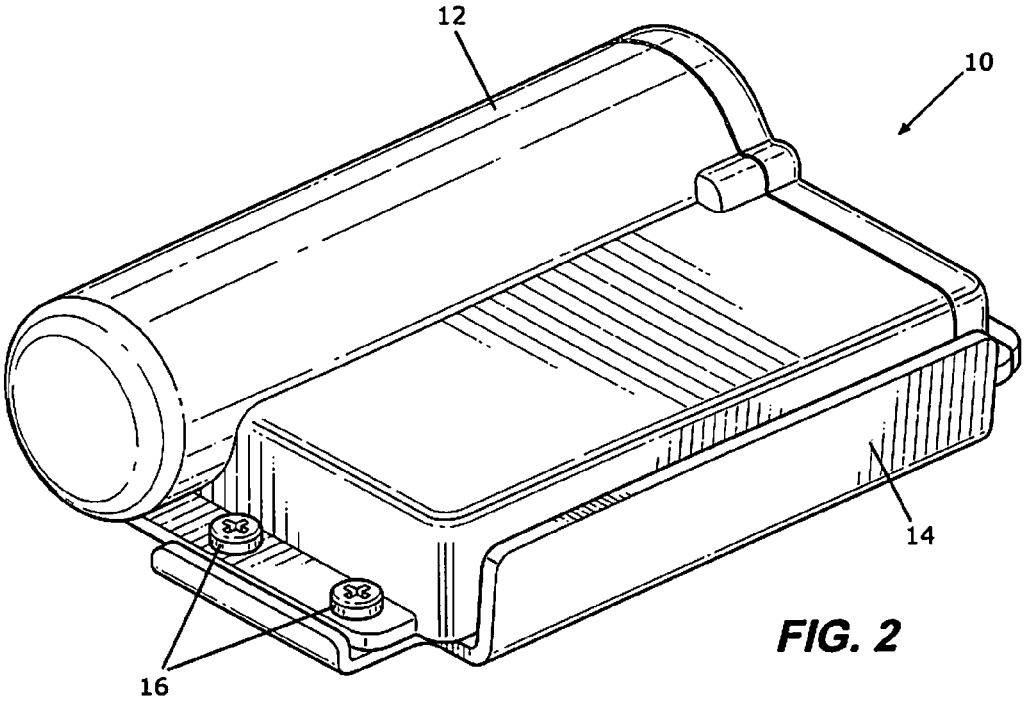
Figure 3:
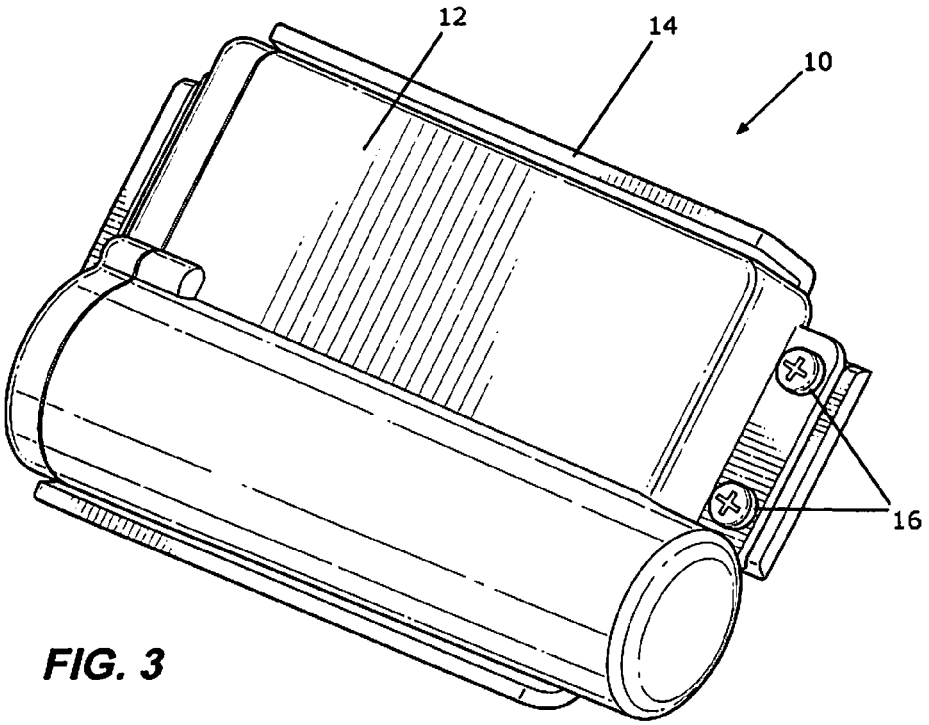
Figure 4A:
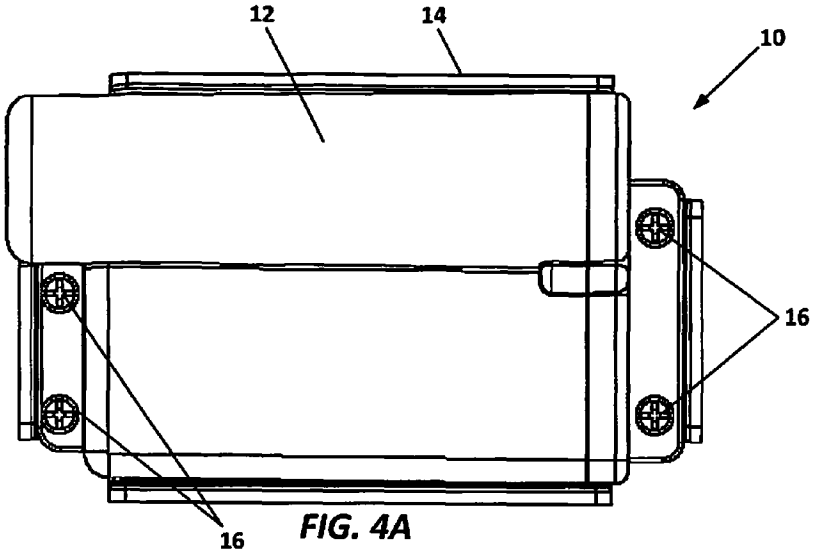
FIG. 4A is a top view of an asset tracking device according to an embodiment of the present disclosure.
Figure 4B:
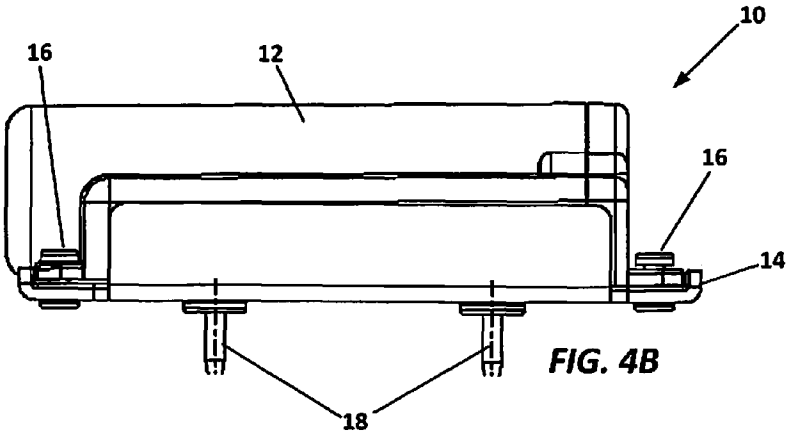
FIG. 4B is a front view of the asset tracking device shown in FIG. 4A.
Figure 4C:
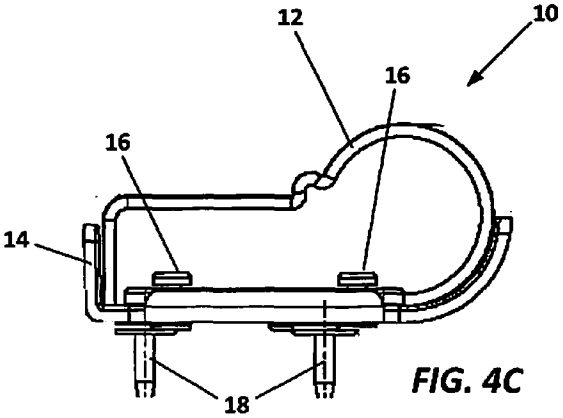
FIG. 4C is a side view of the asset tracking device shown in FIG. 4A.

The figures depict an asset tracking device 10, such as may be used to wirelessly track the location of a shipping container or cargo trailer in transit. Electrical components of the device 10 are contained within a housing 12 which may be constructed from a thermoplastic material. The electrical components are described in more detail hereinafter.

The device 10 includes a mounting bracket 14 having fasteners 18 for attaching the mounting bracket 14 to the asset to be tracked. In one embodiment, the fasteners 18 are screws, such as self-tapping sheet metal screws, which pass through holes 24 in the mounting bracket 14 and into a surface of the asset. Alternatively, the fasteners 18 are bolts which pass through the holes 24 and through holes in the surface of the asset, and which are secured by nuts on the opposite side of the attachment structure on the asset. One skilled in the art will appreciate that other fastening means, such as rivets, may be used in other embodiments, and that the invention is not limited by the type of fastener used to hold the mounting bracket 14 to the asset.

The housing 12 of the tracking device 10 is secured to the mounting bracket 14 using fasteners 16. In an embodiment depicted in FIGS. 1, 2, 3 and 4A-4C, the fasteners 16 are screws which are driven into threaded holes 22 in the mounting bracket 14. In another embodiment, the housing 12 may be attached to the mounting bracket 14 using a peel-and-stick adhesive pad. One skilled in the art will appreciate that other fastening means may be used in other embodiments, and that the invention is not limited by the type of fastener used to hold the housing 12 to the mounting bracket 14.

As shown in FIGS. 1, 2, 3 and 4A-4C, when the housing 12 is secured to the mounting bracket 14, the housing 12 covers the fasteners 18 that secure the mounting bracket 14 to the asset. Thus, when the housing 12 is attached to the mounting bracket 14, the fasteners 18 are inaccessible to any tool that may be used for their removal. Accordingly, the presence of the housing 12 prevents removal of the mounting bracket 14 from the asset. In order to gain access to the fasteners 18 to remove the mounting bracket 14 from the asset, one first must remove the housing 12 from the mounting bracket 14.

Figure 5A:
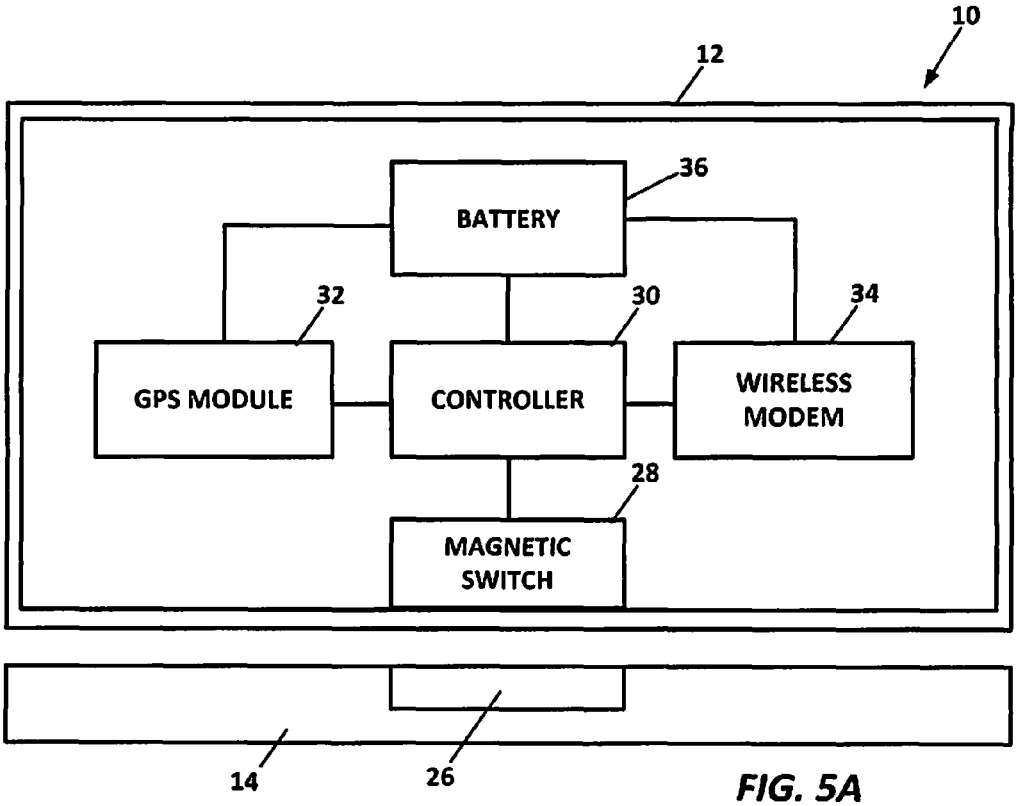
FIGS. 5A and 5B depict a functional block diagrams of the electronic components disposed within the housing of the asset tracking device according to preferred embodiments.
Figure 5B:
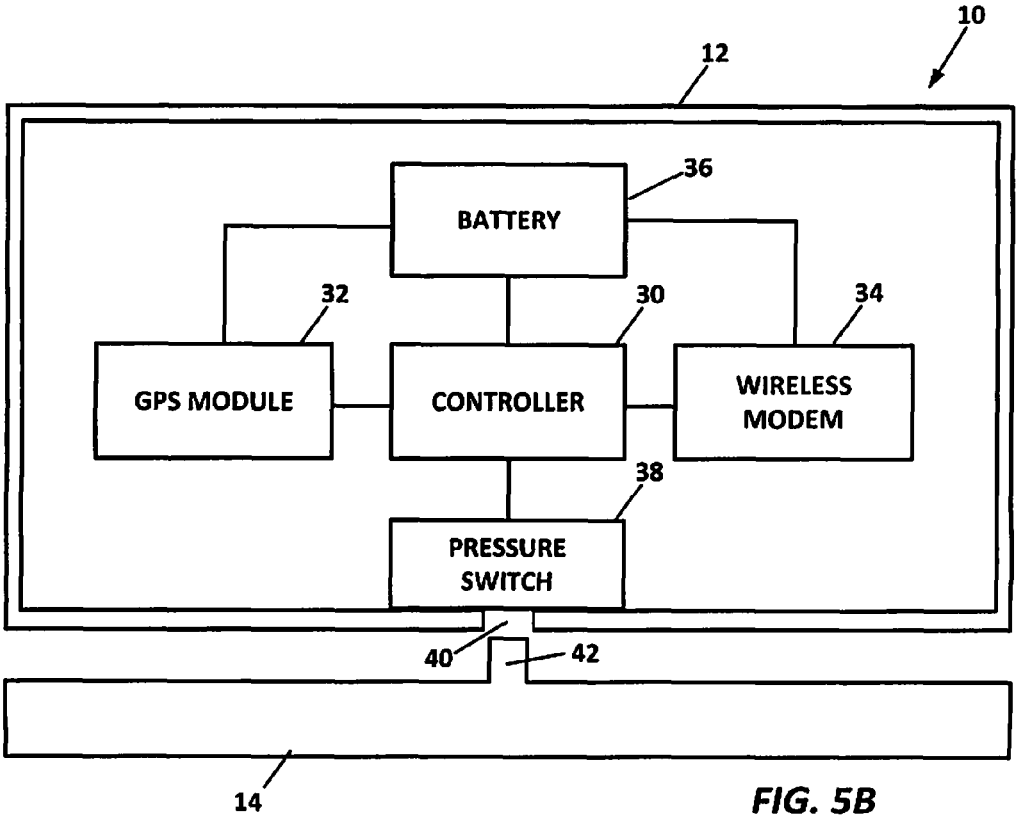

FIGS. 5A and 5B depict functional block diagrams of the electronic components disposed within the housing 12 of the asset tracking device 10 according to preferred embodiments. Both embodiments preferably include a Global Positioning System (GPS) module 32 for determining location coordinates of the asset tracking device 10 based on timing signals received from GPS satellites. The device 10 includes a wireless modem 34, such as a cellular or satellite transceiver, for transmitting the location coordinates or other information to a central monitoring station. The modem 34 may also receive communications from the central monitoring station. A controller 30, which includes microprocessor hardware and firmware, is connected to the GPS module 32 and the wireless modem 34 and controls the operation of the tracking device 10. A battery 36 supplies power to the GPS module 32, controller 30, and wireless modem 34.

The embodiment depicted in FIG. 5A includes a magnetic switch 28 in electrical communication with the controller 30. The magnetic switch 28 is preferably attached in close proximity to an outer wall of the housing 12. In one embodiment, the switch 28 attains an open state when the switch 28 is in close proximity to a magnetic material. In another embodiment, the switch 28 attains a closed state when the switch 28 is in close proximity to a magnetic material. In either embodiment, the controller 30 senses the state of the magnetic switch 28 as being either open or closed. Thus, when the outer wall of the housing 12 to which the switch 28 is attached comes in close proximity to a magnetic material, the switch 28 changes state.

As shown in FIG. 5A, the tracking device 10 includes a magnet 26 embedded in or otherwise attached to the mounting bracket 14 in a location which will cause the magnet 26 to be in close proximity to the magnetic switch 28 when the housing 12 is attached to the mounting bracket 14. In this manner, when the housing 12 is attached to the mounting bracket 14, the magnetic switch 28 is in an open (or closed) state, and when the housing 12 is not attached to the mounting bracket 14, the magnetic switch 28 is in a closed (or open) state. Thus, when the housing 12 is removed from the mounting bracket 14, the magnetic switch 28 transitions from an open (or closed) state to a closed (or open) state.

In the embodiment of FIG. 5B, the tracking device 10 includes a pressure switch 38 in electrical communication with the controller 30. The pressure switch 38 is preferably attached in close proximity to an outer wall of the housing 12 and adjacent to an opening 40 in the outer wall of the housing 12. This embodiment also includes a post 42 protruding from the surface of the mounting bracket 14 in a location at which the post 42 will protrude through the opening 40 and make contact with the pressure switch 38 when the housing 12 is attached to the mounting bracket 14.

When the post 42 presses against the pressure switch 38, the switch 38 is in a closed (or open) state, and when the post 42 does not press against the switch 38, the switch is in an open (or closed) state. In this manner, when the housing 12 is attached to the mounting bracket 14, the pressure switch 38 is in a closed (or open) state, and when the housing 12 is not attached to the mounting bracket 14, the pressure switch 38 is in an open (or closed) state. Thus, when the housing 12 is removed from the mounting bracket 14, the pressure switch transitions from a closed (or open) state to an open (or closed) state. In embodiments incorporating the pressure switch 38, a rubber O-ring gasket may be disposed around the opening 40 and between the housing 12 and the surface of bracket 14 to prevent entry of water.

In either of the embodiments described above, when the housing 12 of the tracking device 10 is removed from the mounting bracket 14, the controller 30 senses the change in state of the switch 28 or 38 and triggers the wireless modem 34 to transmit a tamper alert signal indicating to the central monitoring station that the housing 12 has been removed from the mounting bracket 14. The tamper alert signal may also include location coordinate information from the GPS module 32 indicating the location of the asset at the time the tracking device was removed. If this was an unscheduled and unauthorized removal, the central monitoring station may then take action to recover the asset, such as by notifying law enforcement.

In other embodiments, a separate mounting bracket 14 is not required for the tracking device 10 to transmit a tamper alert signal upon removal from the asset. For example, in the embodiment of FIG. 5B, the post 42 protruding through the opening 40 may be a component of the pressure switch 38 rather than a part of a mounting bracket. When the housing 12 is attached to the asset, the post 42 presses against the surface of the asset thereby causing the pressure switch 38 to be in a closed (or open) state. When the housing 12 is separated from the asset, the post 42 does not press against the surface of the asset, thereby causing the pressure switch 38 to be in an open (or closed) state.

Similarly, in embodiments where the asset tracking device 10 is attached to an asset having a magnetic surface, a separate mounting bracket having a magnet is not needed to cause the magnetic switch 28 to change state upon removal from the asset.

In alternative embodiments, an optical switch, such as an infrared switch, may be used to detect when the housing 12 is attached to the mounting bracket 14 or to a surface of the asset. Those skilled in the art will be familiar with various types of photoelectric sensors that may be used for this purpose.

In other alternative embodiments, other types of proximity sensors may be employed to detect when the housing 12 is attached to the mounting bracket 14 or to a surface of the asset, such as capacitive or inductive sensors.

In yet other alternative embodiments, electrical contacts on the bottom outside surface of the housing 12 could close a circuit by contacting a conductive strip on the bracket 14, or by contacting conductive material from which the bracket 14 is made, or by contacting conductive material on a surface of the asset being tracked. Removal of the housing 12 from the bracket 14 or surface of the asset would cause this circuit to open, which event is monitored by the controller 30.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An asset tracking device comprising:

a mounting bracket configured to be attached to a surface of an asset to be tracked, the mounting bracket having means for securely attaching the mounting bracket to the surface of the asset;

a housing configured to be attached to the mounting bracket and having means for securely attaching the housing to the mounting bracket, the housing sized and configured to substantially make the means for attaching the mounting bracket to the surface of the asset inaccessible when the housing is attached to the mounting bracket, such that the mounting bracket may not be removed from the surface of the asset if the housing is attached to the mounting bracket;

switch means disposed in or on the housing for attaining a first state if the housing is attached to the mounting bracket and for attaining a second state if the housing is not attached to the mounting bracket;

a controller disposed within the housing, the controller operable to generate tamper alert information based on the switch means changing from the first state to the second state; and a transmitter disposed within the housing, the transmitter configured to wirelessly transmit the tamper alert information.

2. The device of claim 1 further comprising:

a location determination circuit disposed within the housing for generating location information indicative of a location of the asset tracking device; and the transmitter configured to wirelessly transmit the location information.

3. The device of claim 1 wherein the means for securely attaching the mounting bracket to the surface of the asset include one or more first apertures in the mounting bracket configured to receive one or more first fasteners.

4. The device of claim 1 wherein the means for securely attaching the housing to the mounting bracket include one or more second apertures in the mounting bracket substantially aligned with one or more third apertures in the housing, all configured to receive one or more second fasteners.

5. The device of claim 1 wherein at least a portion of the mounting bracket comprises a magnetic material and the switch means comprise a magnetic switch.

6. The device of claim 1 wherein the switch means comprise a pressure switch.

7. The device of claim 1 wherein the switch means comprise a photoelectric switch.

8. The device of claim 7 wherein the photoelectric switch is an infrared switch.

9. The device of claim 1 wherein the switch means comprise an optical switch.

10. The device of claim 1 wherein the switch means comprise a conductive material on the mounting bracket and at least two electrical contacts disposed on a bottom outside surface of the housing for contacting the conductive material on the mounting bracket, whereby contacting the at least two electrical contacts to the conductive material on the mounting bracket causes the switch means to be in the first state.

11. The device of claim 10 wherein the conductive material is a conductive strip disposed on the mounting bracket and configured for contacting the at least two electrical contacts.

12. An asset tracking device comprising:

a mounting bracket having a magnetic portion, the mounting bracket configured to be securely attached to a surface of an asset to be tracked, the mounting bracket having one or more first apertures configured to receive one or more first fasteners for securely attaching the mounting bracket to the surface of the asset, the mounting bracket also having one or more second apertures configured to receive one or more second fasteners;

a housing configured to be securely attached to the mounting bracket, the housing having one or more third apertures substantially aligned with the one or more second apertures in the mounting bracket, the one or more third apertures configured to receive the one or more second fasteners for securely attaching the housing to the mounting bracket, the housing sized and configured to substantially make the one or more first fasteners in the mounting bracket inaccessible when the housing is attached to the mounting bracket, such that the mounting bracket may not be removed from the surface of the asset when the housing is attached to the mounting bracket;

a magnetic switch disposed in or on the housing and adjacent the magnetic portion of the mounting bracket when the housing is attached to the mounting bracket, the magnetic switch configured to attain a first state when the housing is attached to the mounting bracket and a second state when the housing is not attached to the mounting bracket;

a controller disposed in the housing, the controller operable to generate tamper alert information based on the magnetic switch changing from the first state to the second state;

a location determination circuit disposed in the housing for generating location information indicative of a location of the asset tracking device; and a transmitter disposed in the housing, the transmitter configured to wirelessly transmit the tamper alert information and the location information.

* * * * *